US005441586A

United States Patent [19]

Fukunaga et al.

[11] Patent Number: 5,441,586

[45] Date of Patent: Aug. 15, 1995

[54] LABEL ADHESION DEVICE AND PRINTER FOR INDEX LABELS

[75] Inventors: Yuzo Fukunaga, Kawasaki; Tsuneo Yasui; Takashi Okumura, both of Nagoya, all of Japan

[73] Assignee: Brother Kogyo Kabushiki Kaisha, Nagoya, Japan

[21] Appl. No.: 172,917

[22] Filed: Dec. 27, 1993

[30] Foreign Application Priority Data

Jan. 5, 1993 [JP] Japan ..... 5-000300

[51] Int. Cl.[6] ..... B65C 1/02

[52] U.S. Cl. ..... 156/387; 156/540; 156/552; 156/555; 400/120.01; 400/615.2

[58] Field of Search ..... 400/690.1, 615.2, 120.01; 156/556, 542, 543, 540, 552, 555, 387

[56] References Cited

U.S. PATENT DOCUMENTS

| | | | |
|---|---|---|---|
| 4,026,117 | 12/1986 | Dumusc | 400/690.1 |
| 4,968,378 | 11/1990 | Borel | 156/552 |
| 5,141,572 | 8/1992 | Gerber | 156/556 |
| 5,222,818 | 6/1993 | Akiyama et al. | 400/615.2 |
| 5,230,765 | 7/1993 | Weiserfish et al. | 156/542 |
| 5,279,696 | 1/1994 | Zangenfeind et al. | 156/540 |
| 5,298,104 | 3/1994 | Absher | 156/552 |
| 5,342,818 | 8/1994 | Imai et al. | 156/240 |
| 5,350,350 | 9/1994 | Maccalli | 156/552 |

*Primary Examiner*—Edgar S. Burr
*Assistant Examiner*—John S. Hilten
*Attorney, Agent, or Firm*—Oliff & Berridge

[57] ABSTRACT

In a label adhesion device for automatically adhering a plurality of labels on one side of a plurality of adhered to members, a cassette storing an ink ribbon, a first roll type support member on which a plurality of print labels are temporarily adhered and a second roll type support member on which a plurality of cover labels are temporarily adhered is detachably mounted on a movable carriage for movement along one side or end portion of an adhered to member inserted in a sheet inlet provided on a main body case of the label adhesion device. The carriage includes a print head for printing desired character image on a projected portion of the label, a drive unit for feeding the first roll type support member and the second roll type support member in a predetermined direction, and a pressing unit for pressing the print label and the cover label holding the adhered member therebetween. The carriage is moved a predetermined distance according to data for number of labels, label size and interval of labels for printing the label and adhering it to the successive adhered to members at each position.

20 Claims, 10 Drawing Sheets

LABEL ADHESION DEVICE AND PRINTER FOR INDEX LABELS

BACKGROUND OF THE INVENTION

1. Field of the Invention

The invention relates to a device for adhering labels such as index labels onto one side of an adhered to member such as a loose-leaf notebook sheet, a document holder or a printing paper.

2. Description of Related Art

Conventionally, an index label has a symmetric shape according to a folding line which exists at the center of its right and left portion. The conventional index label has a base portion to be adhered on one side of the adhered to member, such as the loose-leaf notebook sheet, and a projected portion on which desired characters can be written. These two portions are connected to each other. A pressure-sensitive adhesive is coated on the back of the index label.

When there are a plurality of the adhered to members, such as the loose-leaf notebook sheets, and a plurality of the index labels, the operator manually enters desired characters on the surface of the projected portion of the index label and manually adheres the index labels to the adhered to members. The position where the index labels are adhered to the adhered to members, along the longitudinal direction of a side or end portion of each adhered to member may be adjusted so that underlying index labels may be completely or partially read.

However, if there are a large number of index labels, it takes much time to manually enter the desired characters onto the index labels. If the label size is small, the characters are not entered onto the index labels easily. Moreover, if the index labels are manually adhered to the adhered to member, the labels may adhere to the adhered to member when contacted to the adhered to member at an undesired or incorrect position. As a result, the array of the plurality of index labels is uneven and it looks unattractive.

To prevent this, the user must apply a mark to the adhered to members to show an adhering position for each index label. Only in such a way can a plurality of index labels be attached to the adhered to members at constant intervals so as to show clearly each character written in the projected portion of each index label. Doing so takes a lot of time.

SUMMARY OF THE INVENTION

An object of the invention is to provide a label adhesion device capable of printing desired characters thereon, and capable of adhering the labels easily onto a plurality of adhered to members at predetermined intervals.

In order to achieve this object, a label adhesion device of the invention comprises a carriage which is movable along one side of an adhered to member, a first support member on which a plurality of print labels are temporarily adhered, the print label comprising a base portion which can be adhered on one side of the adhered to member and a projected portion connecting to the base portion and on which a desired image can be printed, a second support member on which a plurality of cover labels are temporarily adhered, print means for printing a desired image on the projected portion of the print label, feeding means for feeding the first support member and the second support member in a predetermined direction, pressing means for adhering and pressing the print label and the cover label holding the one side of the adhered to member therebetween and control means for controlling the carriage to move so that a label adhering position on the plurality of adhered members may be shifted in a direction along the one side of the adhered to member.

In the label adhesion device thus structured, when a first adhered member is inserted in the label adhesion device, the carriage automatically moves along one side end portion of the adhered to member to a predetermined position where a first label should be adhered according to the input data about the number of labels, label size and position of the first label to be adhered. Then the predetermined words and phrases are automatically printed on the first label according to the input print data and the printed label is automatically adhered on the first adhered member. Consequently, a second adhered to member is inserted in the label adhesion device, the carriage automatically moves to a predetermined position where a second label should be adhered according to the input data about label size and the interval between each label. Then the predetermined words and phrases are automatically printed on the second label according to the input print data, and the printed label is automatically adhered on the second adhered to member.

As described above, according to the label adhesion device of the invention, the printing operation and the adhering operation of the labels are automatically executed. As a result, time, trouble and aggravation in executing the printing and adhering operations are saved, compared with the conventional manual operation, and the well arrayed index labels have neatly printed images.

Further, the printed labels are covered by the cover labels having the same shape as the print labels, so that the printed portion does not peel off and the printed image does not blur, even after a long time has passed.

And further, if various kinds of cassettes, storing variously sized index labels and cover labels with corresponding ink ribbons are prepared, and the thermal print head, whose size corresponds to the largest size of index label, is provided on the carriage, index labels having various lengths of words and phrases can be printed as necessary and adhered onto the adhered to member by changing the cassette.

BRIEF DESCRIPTION OF THE DRAWINGS

A preferred embodiment of the invention will be described in detail with reference to the following figures wherein.

DETAILED DESCRIPTION OF THE PREFERRED EMBODIMENT

Figure 1:
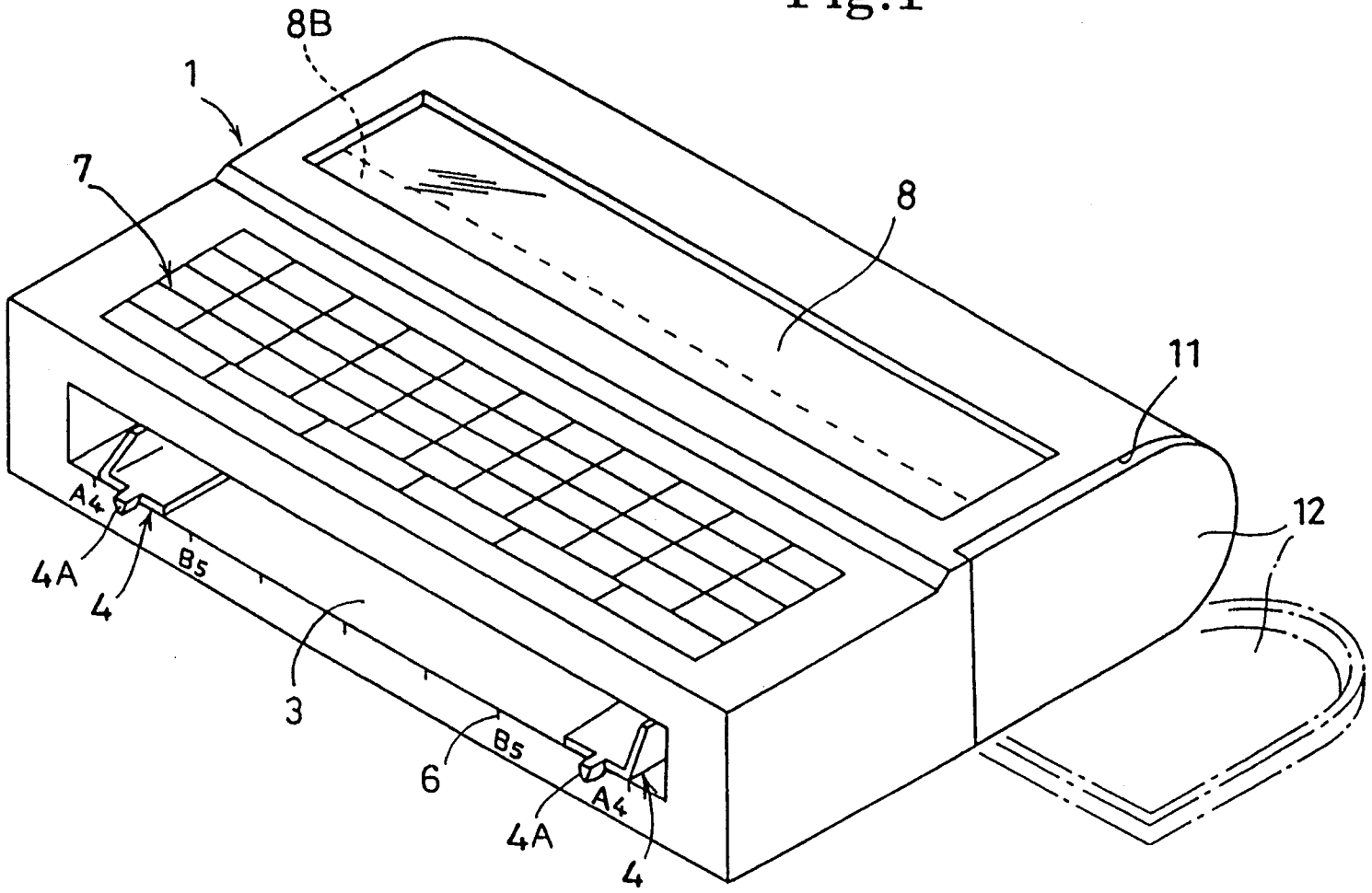
FIG. 1 is a perspective view of a label adhesion device.
Figure 2:
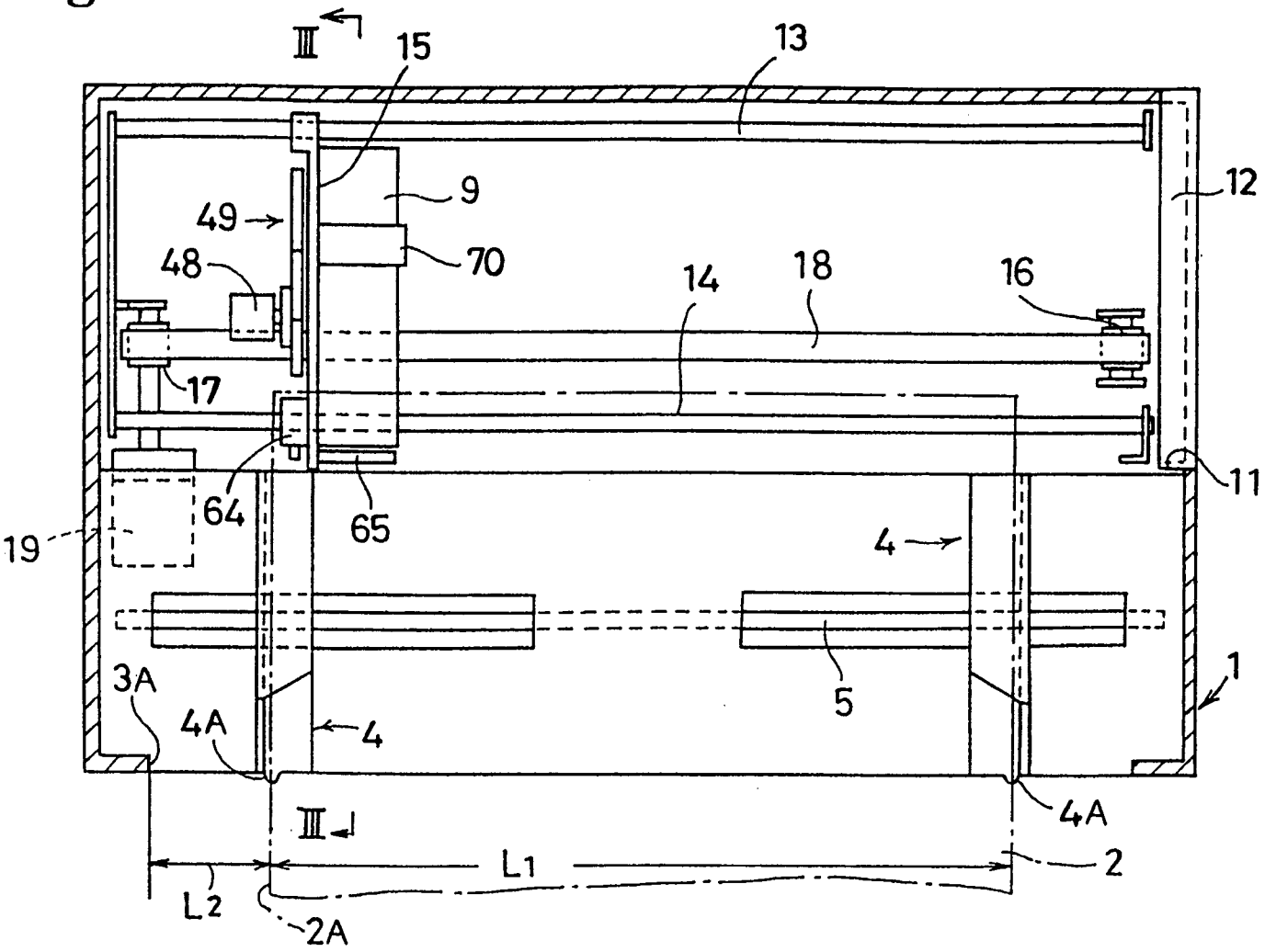
FIG. 2 is a cross-sectional view of the label adhesion device.
Figure 3:
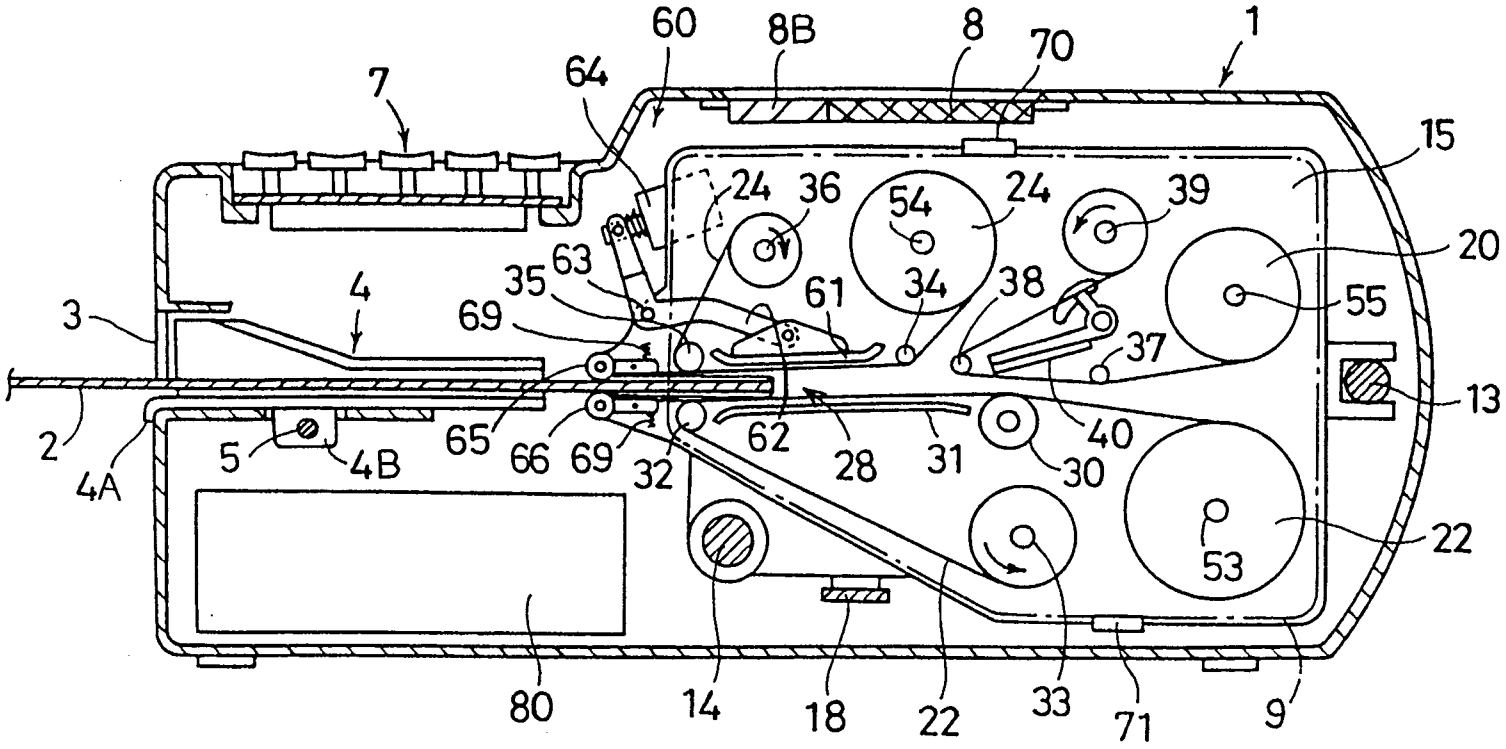
FIG. 3 is a cross-sectional view of the label adhesion device shown from line III—III of FIG. 2.

Hereinafter, one embodiment which embodies the invention will be explained with reference to the drawings. As shown in FIGS. 1 through 3, a sheet inlet 3 where one side of an adhered to member 2, such as loose-leaf notebook sheet, is inserted in a front side of a main body case 1 of the label adhesion device of the invention. The main body case 1 is made of synthetic resin. In the sheet inlet 3, a pair of guide frames 4,4 are movably supported on a rail 5 for guiding the adhered to member 2 and for showing a sheet length and sheet position thereof. When a pair of indicators 4A,4A of the pair of guide frames 4, 4 are located at graduations 6 applied in front of the main body case 1, the adhered to member 2 of a predetermined length, such as A4 size and B5 size, can be inserted between the guide frames 4,4, and the position of the adhered to member 2 can be detected. The length of the adhered to member 2 can be detected by measuring the electric resistance between the rail 5 and supporting portions 4B,4B of the guide frames 4,4. Moreover, a position of the inserted adhered member 2 can be detected by measuring an electric resistance between one supporting portion 4B and one end of the rail 5. It is preferable to use a separate material which is arranged in parallel to the rail 5 as a resistor (not shown) for detecting the above electric resistance. The above electric resistance is detected by a detector 92 arranged on the resistor.

An operation panel unit 7 is arranged on the upper front side of the main body case 1. On the operation panel unit 7 are character input keys to input Japanese Kana characters or letters, symbols and figures, and function keys to input various operation instructions such as for inputting adhering position of an index label 10 (to be described later) and for starting the printing and adhering operation.

Moreover, a display unit 8 of a liquid crystal display element is arranged on the upper back side of the main body case 1. The display unit 8 displays the characters, symbols and figures input from the operation panel unit 7, a procedure of the operation and the condition of the device. At a part of the display unit 8 is a window 8B through which the type of cassette 9 (to be described later) installed on a carriage 15 (to be described later), that is the size of the index label 10 and its color combination, etc., can be observed.

An opening 11 to insert the cassette 9 is formed at a back portion on one side of the main body case 1. The opening 11 is covered by a cover 12. In the space communicating with the opening 11 in the main body case 1 is a pair of guide shafts 13,14 arranged in parallel to the sheet inlet 3. The carriage 15 is movably supported on the pair of guide shafts 13,14. A timing belt 18, extending between pulleys 16,17, is installed on a lower side of the carriage 15. The carriage 15 can be moved along one side or end portion of the adhered to member 2 inserted in the sheet inlet 3 by driving a carriage motor 19, such as a forwardly and backwardly rotatable step motor.

As shown in FIG. 3, stored in the cassette 9, made of a synthetic resin, are an ink ribbon 20, a first roll type support member 22 and a second roll type support member 24. The first roll type support member 22 is made of a synthetic resin film and has a plurality of print labels 21 for printing upon temporarily adhered thereon. The second roll type support member 24 is made of a synthetic resin film and has a plurality of cover labels 23, for covering the print label 21, temporarily adhered thereon. A pressure-sensitive adhesive is coated on the surface of the first roll type support member 22 and the second roll type support member 24. The print labels 21 and the cover labels 23 are temporarily adhered to the first roll type support member 22 and the second roll type support member 24 respectively by contacting a mold releasing agent, such as a silicon resin, coated to the rear surface of each print label 21 and each cover label 23 with the pressure-sensitive adhesive coated on the surface of the first roll type support member 22 and the second roll type support member 24.

Figure 4:
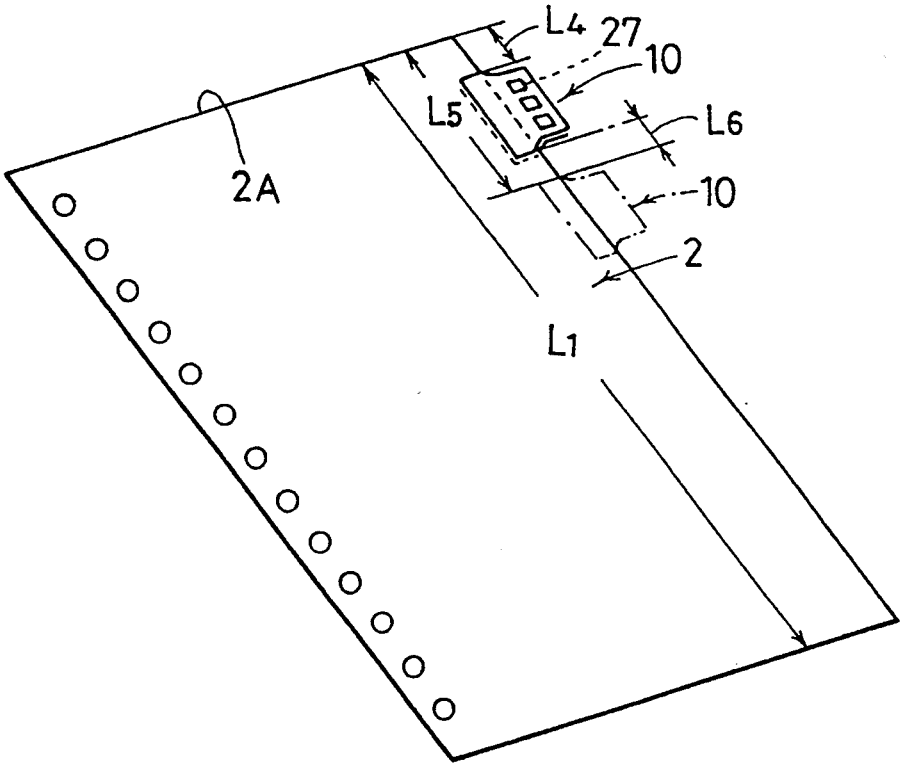
FIG. 4 is a perspective view of the adhered to member onto which an index label is adhered.
Figure 5:
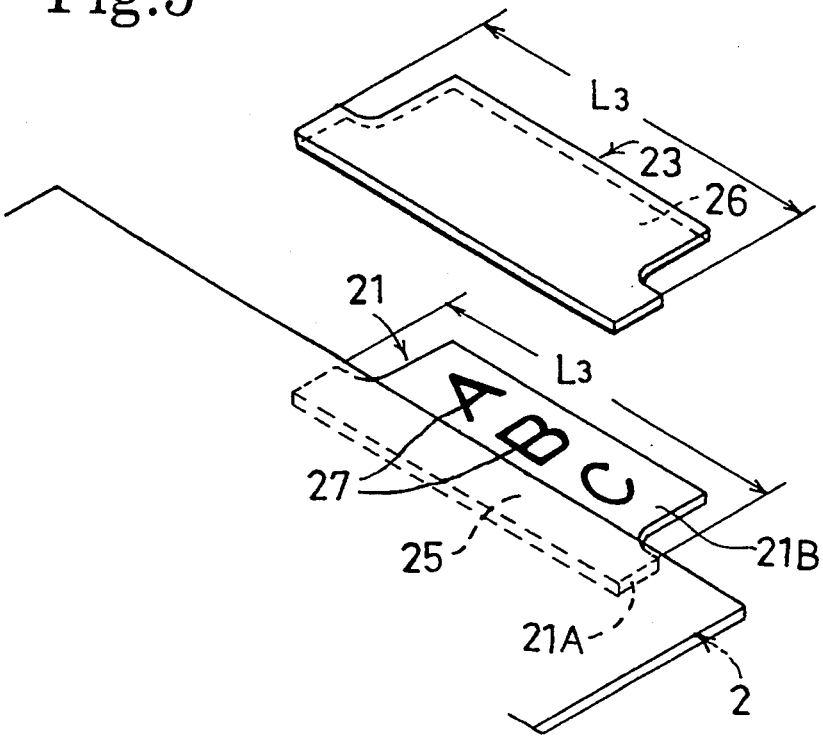
FIG. 5 is a perspective view showing the elements of the index label.

As shown in FIGS. 4 and 5, the index label 10 of the present embodiment is constructed from the print label 21 and the cover label 23. The print label 21 has a base portion 21A and a projected portion 21B on which desired characters 27, symbols and figures can be printed. The projected portion 21B is connected to the base portion 21A. The cover label 23 has a same shape as the print label 21 and is made of a transparent resin film. On the surface of the base portion 21A of the print label 21, that is opposite to the surface temporarily adhered to the first roll type support member 22, is a pressure-sensitive adhesive layer 25 for adhering the print label 21 on one surface of the one side or end portion of the adhered to member 2. The corresponding surface of the projection portion is a print surface and has no adhesive layer. 0n the entire surface of the cover label 23, that is on the surface confronting the print label 21, a pressure-sensitive adhesive layer 26 is also formed. As explained below in detail, after desired characters are printed on the projected portion 21B of the print label 21, the base portion 21A of the print label 21 is adhered on the one surface of one side or end portion of the adhered to member 2. Then, the cover label 23 is adhered to cover both the printed surface of the projected portion 21B of print label 21 and the other surface of the one side or end portion of the adhered to member 2.

Figure 6:
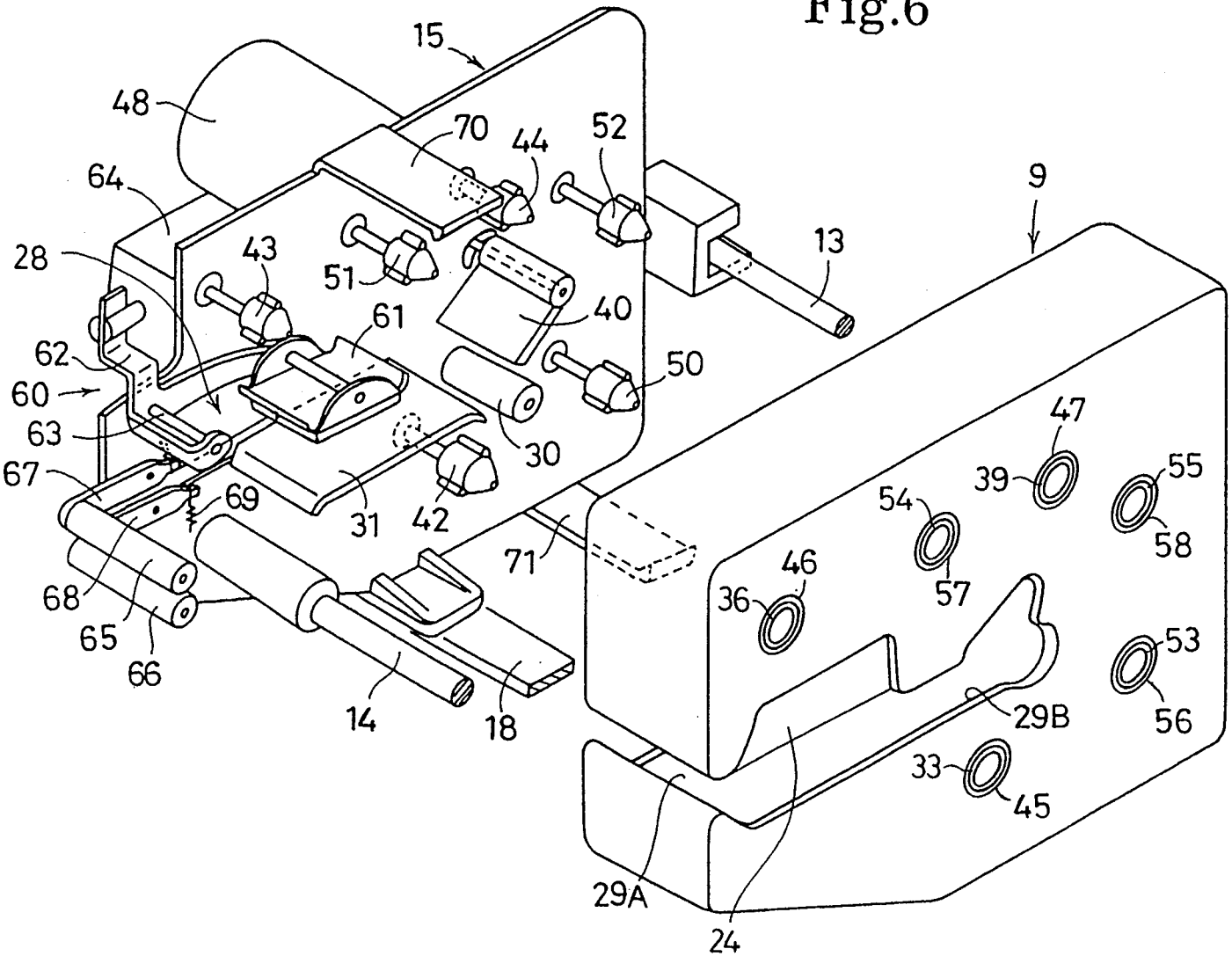
FIG. 6 is a perspective view of a carriage of the label adhesion device and a cassette mounted thereon.

As shown in FIG. 6, an opening groove 29A, for accommodating an adhering operation unit 28, receives the one side or end portion of the adhered to member 2 that is inserted from the sheet inlet 3 of the main body case 1, is formed in one side wall of the cassette 9. An inserting groove 29B is provided in the cassette 9 connecting with the opening groove 29A through which a guide member 31, a thermal print head 40, a platen 30, and a pressing member 61 are inserted. As shown in FIG. 3, the first roll type support member 22 mounted in the cassette 9 is wound around a spool 53 and is fed over the platen 30 and the guide member 31 that project from the carriage 15. The first roll type support member 22 is taken up around a take up spool 33 after passing a guide roller 32 located in the vicinity of the aperture groove 29A of the cassette 9. Moreover, the second roll type support member 24 mounted on the cassette 9 is wound around a spool 54 and is taken up around a take up spool 36 after passing over a guide roller 34 provided in the cassette 9 and around a guide roller 35 located in the vicinity of the aperture groove 29A.

The ink ribbon 20 mounted on the cassette 9 is wound around a spool 55 and is taken up around a take up spool 39 after passing over a guide roller 37 and around a guide roller 38 provided in the cassette 9. The ink ribbon 20 is arranged to pass by the thermal print head 40 of the print unit mounted on the carriage 15.

Figure 7:
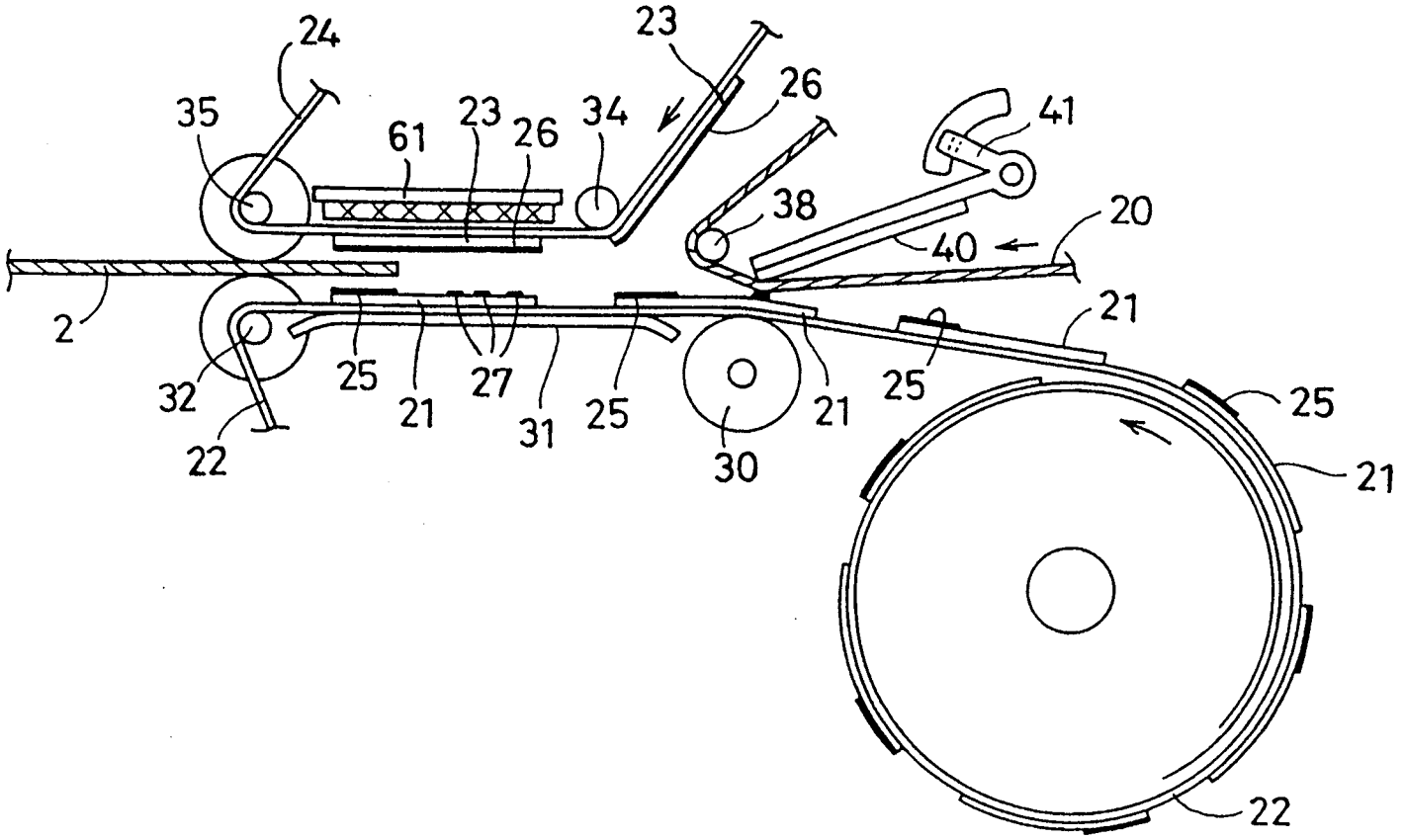
FIG. 7 is a expanded sectional view showing the printing operation unit and adhering operation unit.

As shown in FIGS. 3 and 7, the thermal print head 40 is mounted on the carriage 15 to swing between a position separated from the platen 30 and the surface of the platen 30. The thermal print head 40 is driven to be moved through an arm 41 by an actuator 88, such as electromagnetic solenoid shown in FIG. 8, in order that a tip portion of the thermal print head 40 comes in contact with the platen 30 with the ink ribbon 20 therebetween and a print operation is executed only when the surface of the projected portion 21B of the label 21 passes to the platen 30.

As shown in FIG. 6, a drive shaft 42 for driving the take-up spool 33 for the first roll type support member 22, a drive shaft 43 for driving the take-up spool 36 for the second roll type support member 24, and a drive shaft 44 for driving the take-up spool 39 for the ink ribbon 20 project from the surface of carriage 15. The drive shafts 42,43 and 44 are received in corresponding insertion holes 45,46 and 47 located in the side wall of the cassette 9. The drive shafts 42,43 and 44 are driven to be rotated in a predetermined direction by a drive motor 48, installed on a back side of the carriage 15, through a transmission gear group 49. Further, rotating shafts 50,51 and 52, which rotate freely, extend from the carriage 15. The rotating shafts 50,51 and 52 are engaged with the spool 53 for the first roll type support member 22, the spool 54 for the second roll type support member 24 and the spool 55 for the ink ribbon 20 respectively. The rotating shafts 50,51 and 52 are also received in respective corresponding insertion holes 56,57 and 58 in the side wall of the cassette 9.

Further, a pressing unit 60 is provided on the carriage 15 for pressing the print label 21 and the cover label 23 and holding the one side or end portion of the adhered to member 2 therebetween at the adhering operation unit 28. In the pressing unit 60, a pressing member 61 is arranged to confront with the guide member 31 on the upper side of the guide member 31. The pressing member 61 is arranged at one end of an L-shaped arm 62 and the other end is connected to an actuator 64. The arm 62 is rotatably connected to the carriage 15 by a pin 63 which is provided in a half-way point of the arm 62. The actuator 64, such as electromagnetic solenoid, is installed on the back side of the carriage 15 as shown in FIG. 6. By driving the actuator 64, the guide member 31 can be pressed toward the pressing member 61 to hold and press the print label 21, the cover label 23 and the one side or end portion of the adhered to member 2 held therebetween, thereby completing an adhering operation.

Further, a pair of adhering rollers 65,66 are provided in the vicinity of the pressing unit 60 at a front end of the carriage 15 mounted to a pair of arms 67,68 and biased toward one another by springs 69,69. Thereby, the print label 21, the cover label 23 and the one side or end portion of the adhered to member 2 are further pressed together so that they are firmly adhered. It is preferable that the support structure for adhering rollers 65,66 be such that a space between the rollers 65,66 may become wide so that the adhered to member 2 can be easily inserted therebetween into opening groove 29A and when the carriage 15 is horizontally moved, and the space between the rollers 65,66 may become narrow and the pressure of the rollers 65,66 may increase when the adhered to member 2 is pulled from the opening groove 29A. Movement of the arms 67,68 may be executed by a release mechanism for the arms 67,68 using an actuator (not shown). Moreover, a pair of projections 70,71, made of an elastic member, horizontally project from a top and bottom portion of the carriage 15 to hold the cassette 9 when installed on the carriage 15.

Figure 8:
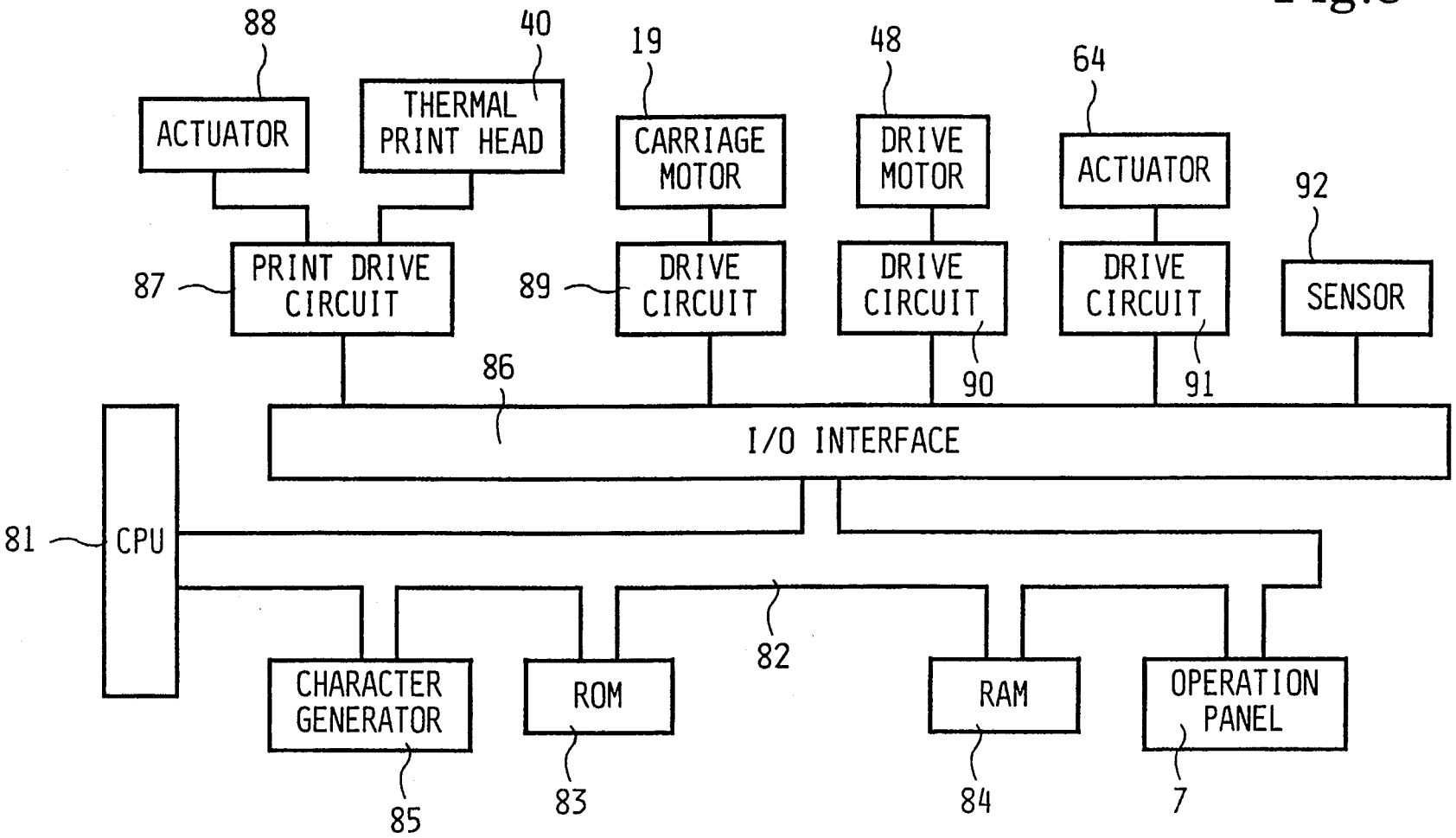
FIG. 8 is a block diagram of a control unit of the label adhesion device.

A control unit of the label adhesion device of the invention will be explained with reference to the block diagram of FIG. 8. A read only memory (ROM) 83 for storing a predetermined processing program, a random access memory (RAM) 84 for temporarily storing operating data, a character generator 85, the operation panel unit 7, and an I/O interface 86 are connected to a processor (CPU) 81, such as a microcomputer, stored in the main body case 1 through an internal bus 82 (including a data bus and a control bus). Further, a print unit drive circuit 87 for driving the thermal print head 40 and the actuator 88 for swingably moving the thermal print head 40, a drive circuit 89 for driving the carriage motor 19, a drive circuit 90 for driving the drive motor 48 for taking up the ink ribbon 20, the first roll type support member 22, and the second roll type support member 24 stored in the cassette 9, a drive circuit 91 for driving the actuator 64 for the pressing unit 60, and the sensor 92 for detecting an inserted sheet length and sheet position corresponding to the guide frames 4,4 are connected to the I/O interface 86.

Figure 9A:
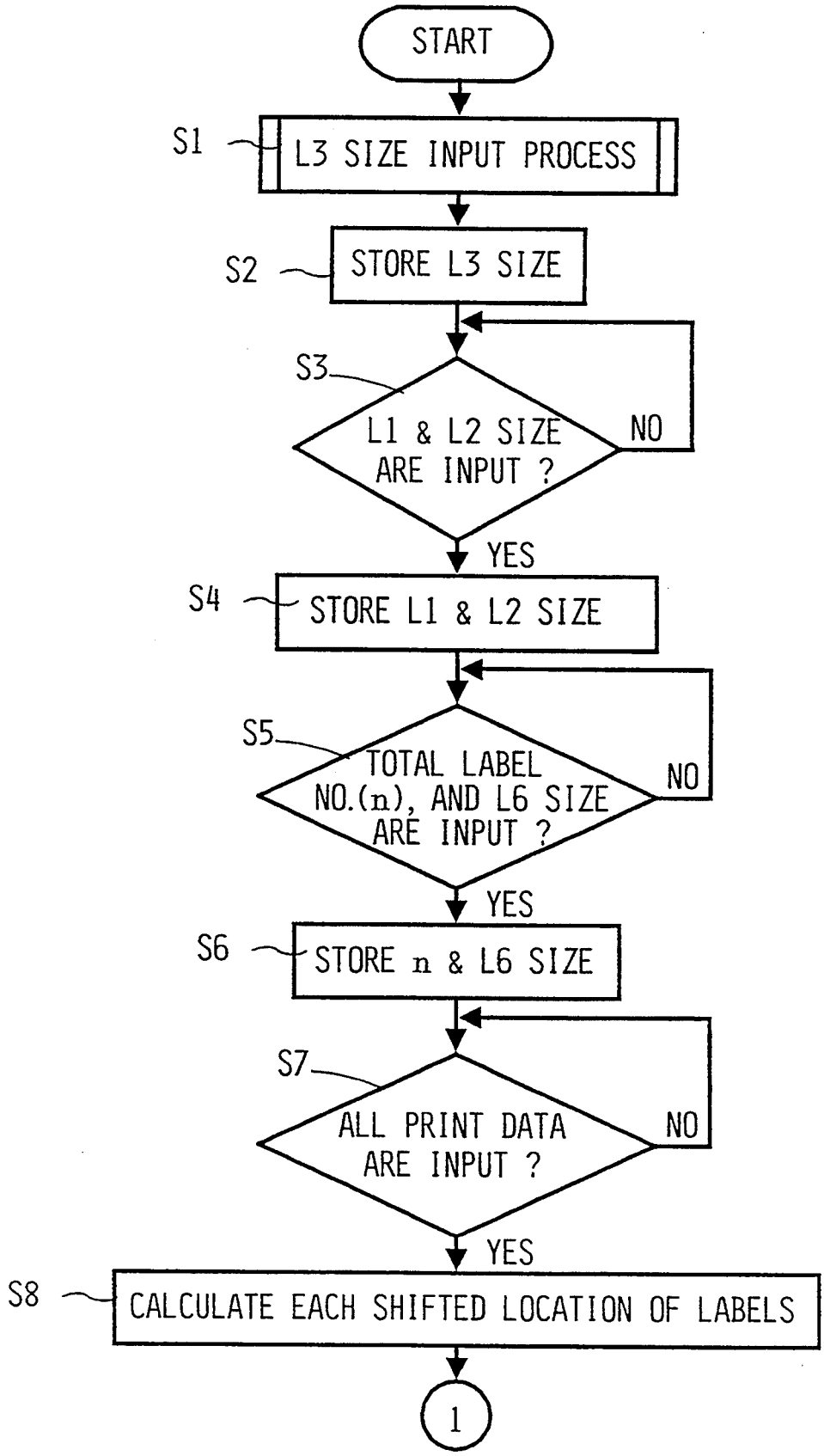
FIGS. 9(A), 9(B) and 9(C) are a flowchart of the operation of the label adhesion device.
Figure 9B:
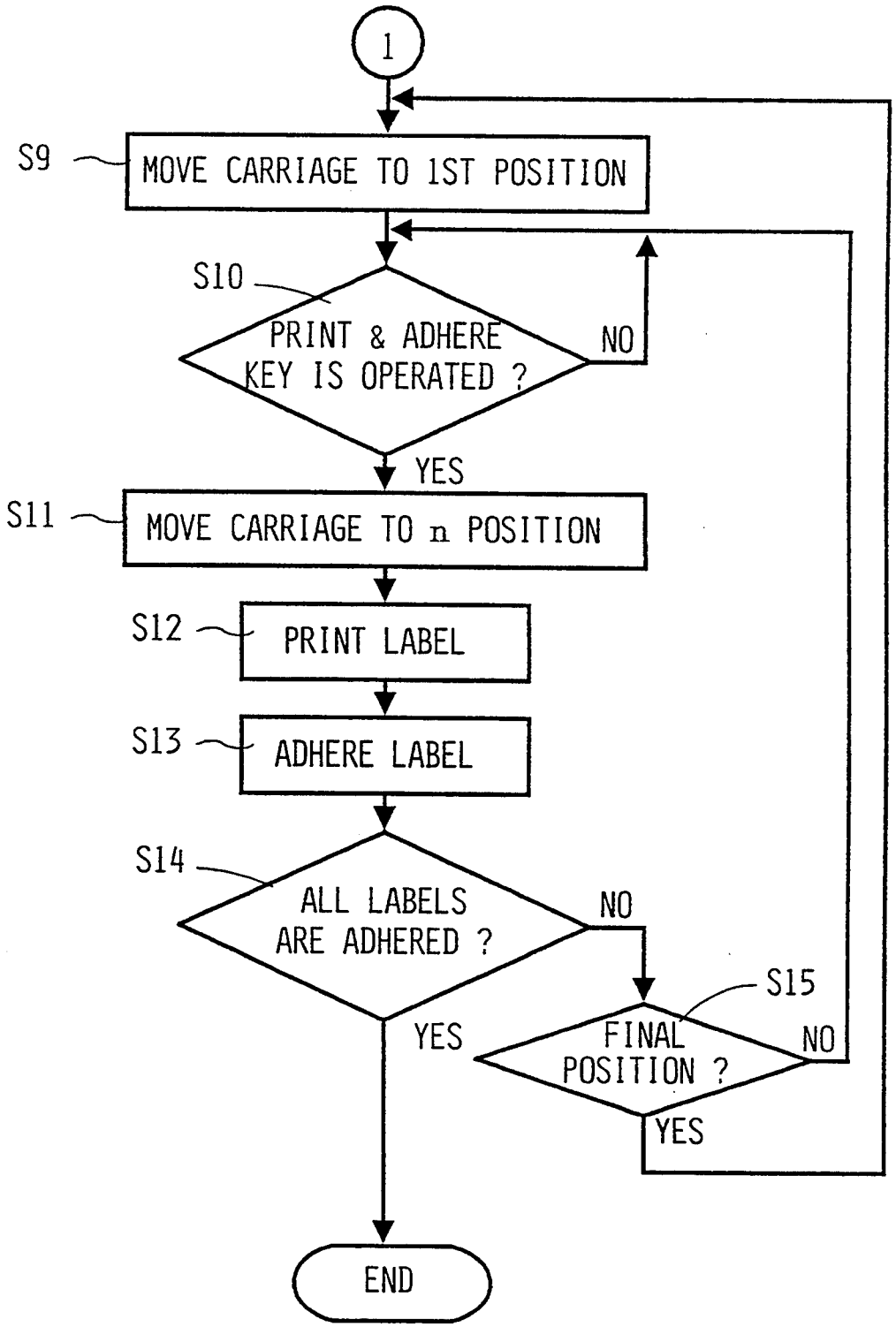
Figure 9C:
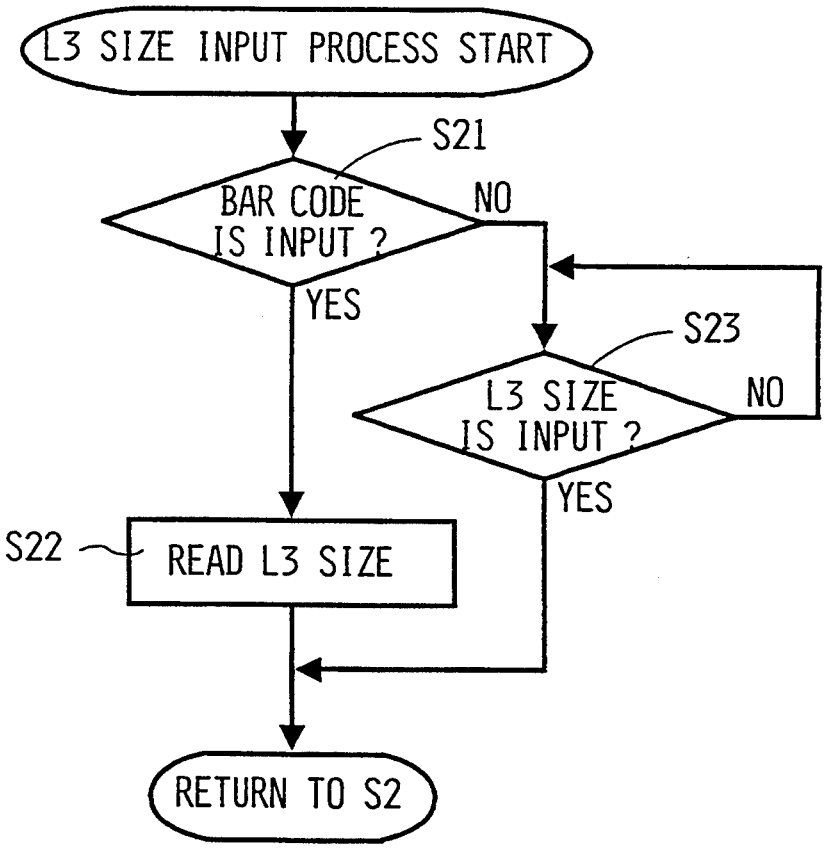

The label adhesion device of the invention operates as will be explained with reference to the flowchart of FIGS. 9(A), 9(B) and 9(C). In the flowchart Si (i=1,2,3 . . . ) designates the steps.

First, when a power supply switch (not shown) provided in a suitable position on the main body case 1 is turned on, and an operation key for installing the cassette 9 is input, the carriage 15 moves to the vicinity of the cover 12. Then, the cover 12 is opened, the cassette 9 is inserted through the opening 11 so that the cassette 9 is installed on the carriage 15.

In this embodiment, the print labels 21, stored in the cassette 9, are made of a non-transparent material such as paper and the cover labels 23, also stored in the cassette 9, are made of a transparent film. The length of each label is L3. A L3 size input process will be explained with reference to FIG. 9(C). When the cassette 9 is installed on the carriage 15, the length L3 of the print label 21 and the cover label 23 is recognized from a bar code attached on a side surface of the cassette 9 which is read by a sensor (not shown) (S21:YES, S22) or by inputting using keys on the operation panel unit 7 (S21:NO; S23:YES). Then the flow returns to the main routine and the data about the length L3 of the print label 21 and the cover label 23 is stored in the RAM 84 (S2).

Next, the main routine will be explained with reference to FIGS. 9(A) and 9(B). The pair of guide frames 4,4 in the sheet inlet 3 of the main body case 1 are moved according to a length L1 of the adhered to member 2, such as a loose-leaf notebook sheet, and positioned by the operation of an adhered member size define key (not shown) which is one of the function keys on the operation panel unit 7. Thereby, a distance L2 (for example for an A4 sheet) between a standard position (such as one end 3A of the sheet inlet 3) and one end 2A of the adhered to member 2 (the A4 sheet of the example), and the length L1 of the adhered member 2 are detected by the sensor 92 as corresponding to an electric resistance between the guide frames 4,4 and the rail 5 or the separate material arranged parallel to the rail 5 as the resistor (S3:YES). The data of the length L1 and the distance L2 are stored in the RAM 84 (S4). Alternatively, the length L1 and the distance L2 can be input using keys on the operation panel unit 7. At this time, the pair of guide frames 4,4 are automatically driven to move, according to the distance input by the key operation, by a guide frame drive unit (not shown).

Next, the operator inputs the number (n) of the adhered to members 2 to which index labels 10 should be adhered using an input key operation and also inputs a distance L6 between each label 10 using the operation panel unit 7 (S5:YES). The number n and the distance L6 are stored in the RAM 84 (S6). The distance L6 may be 0 mm, but is preferably 2 mm to best show the index labels 10. Next, when the operator inputs the printed data, such as words and phrases, etc., to be printed on each index label 10 using the character, appropriate figure and symbol keys, the input print data is stored in the RAM 84. For instance, if ten adhered to members 2 are to be prepared, ten words or phrases are input. When all the print data is input (S7:YES), the shifted location of each index label 10 can be calculated from the input print data and the input data of the length L1 and the distances L2 and L6 by executing the control program (S8).

The first sheet of the adhered to members 2 is then inserted along the pair of guide frames 4,4 into the sheet inlet 3. The adhered to member 2 on which the index label 10 is adhered is shown in one-dot chain line in FIG. 2. When the adhered to member is so positioned, the carriage motor 19 is started and the carriage 15 moves automatically to and stops at the position where the first index label 10 will be adhered, that is to a position removed from the one end 2A of the first adhered to member 2 so that one edge of the index label will be separated from the one end 2A for the predetermined distance L4 (S9). The distance L4 is calculated in step S8 based upon the number n of index labels 10, the length L3 of the index labels 10, and the distance L6 between index labels 10. Alternatively, the distance L4 can be input in step S5 and stored in RAM 84 in step S6. Then, when an operation key for printing and adhering (not shown) is pressed (S10:YES), the carriage 15 moves automatically and stops at the $n^{th}$ position where the $n^{th}$ index label 10 will be adhered (S11). When the index label 10 to be adhered is the first index label 10, the $n^{th}$ position is the first position, so that the carriage 15 does not move. Then the drive motor 48 is operated for a predetermined time, and the take-up spool 33 of the first roll type support member 22 is rotated to feed the print label 21, in the cassette 9, in the direction of the upper surface of the platen 30. At this time, the ink ribbon 20 and the second roll type support member 24 of the cover label 23 are also moved synchronizingly.

When the print label 21 stops at a position that the projected portion 21B of the print label 21 reaches the printing position on the platen 30, the actuator 88 is operated and the thermal print head 40 is moved into contact with the projected portion 21B, positioned on the platen 30, with the ink ribbon 20 therebetween. At that time, when a print instruction is sent to the thermal print head 40, the print data input and stored in the RAM 84 for the first index label 10 is printed on the surface of the projected portion 21B of the print label 21. After the print operation is completed, the actuator 88 operates in reverse and the tip of the thermal print head 40 is separated from the platen 30 (S12).

The drive motor 48 is then operated so that the printed print label 21 and the cover label 23 are moved to the position over guide member 31 where both the base portion 21A of the print label 21 and the base portion of the cover label 23 hold the one side or end portion of the adhered to member 2 positioned therebetween (FIG. 7). The actuator 64, corresponding to the pressing unit 60, is operated and the pressing member 61 is moved to come toward contact with the guide member 31 compressing the print label 21, the one side or end portion of the adhered to member 2, and the cover label 23. Thereby, the printed print label 21 and the cover label 23 are adhered by the pressure-sensitive adhesive layers 25,26 holding the one side or end portion of the adhered to member 2 therebetween (S13).

Because the temporary adhesion power of the print label 21 to the first roll type support member 22 and the temporary adhesion power of the cover label 23 to the second roll type support member 24 are weaker than the adhesion power between the pressure-sensitive adhesive layers 25,26, the print label 21 and the cover label 23 peel-off from the respective surfaces of the first roll type support member 22 and the second roll type support member 24 easily. The actuator 64 of the pressing unit 60 is then operated reversely and the pressing member 61 is separated from the guide member 31. At the same time, the drive motor 48 is operated again so that the first roll type support member 22 is taken up around the take-up spool 33 and the second roll type support member 24 is taken up around the take-up spool 36 respectively.

When the adhered to member 2 is pulled from the sheet inlet 3, the print label 21 and the cover label 23 are firmly adhered to each other by being strongly pressed by the pair of rollers 65,66. When all of the index labels 10 have not been adhered and it is determined that the position where the last index label 10 was adhered is not the final position (shown in FIG. 5) (S14:NO; S15:NO), then flow returns to step S10.

Then, the rollers 65,66 are separated and the second sheet of the adhered to member 2 is inserted along the pair of guide frames 4,4 into the sheet inlet 3 in the same manner as the first sheet. With the second adhered to member 2 positioned, the operation key for printing and adhering (not show,n) is operated (S10:YES) and the carriage motor 19 starts to operate.

The carriage 15 moves automatically and stops at the position where the second index label 10 will be adhered, that is at a position separated from the one end 2A of the second adhered member 2 so that mounting of the index label 10 is such that one end is a predetermined distance L5 (L5=L3+L4+L6) from the one end 2A as shown by one-dot chain line in FIG. 4 (S11). In the same manner as with first adhered to member 2, the print label 21, the cover label 23 and the ink ribbon 20 are moved to a position for printing the print data on the projected portion 21B (S12) and then they are moved so that the adhered to member 2, the printed print label 21 and the cover label 23 are adhered to each other (S13).

For example, in order to adhere the index label 10 whose length is 25 millimeters (L3=25 mm) to the adhered to member 2 of A4 size (L1=296 mm) without covering the projected portion of each subsequent index label 10 on which the desired image is printed, the print label 21 and the cover label 23 are adhered after the carriage 15 is moved for a set interval, that is for a distance of the length L3 of the index label 10 plus the distance L6 between each index label 10, for example 30 millimeters (L3=25 mm, L6=5 mm). When all of the designated number n of the index labels 10 cannot be adhered in the length L1 of the adhered to member 2, that is, it is determined that the position where the last index label 10 has been adhered is the final position on an adhered to member 2 (S15:YES), then flow returns to step S9 and the carriage 15 returns to the end portion 2A of the next adhered to member 2 and stops at the position starting where the carriage 15 adheres the index label 20 to the adhered to member 2 at a distance L4 from the end portion 2A (the first position). The printing and adhering operations for the following index labels 10 are then executed. When it is judged that all index labels to have been adhered (S14:YES), the process ends.

According to the label adhesion device of the invention, it is extremely easy to adhere the index label 10 to the adhered member 2 with a constant interval in order to clearly show all printed images printed on the projected portion 21B of each index label 10 when there are a plurality of adhered to members 2 to each of which an index labels must be adhered. It is possible to automatically print the desired image on the index label 10 and to adhere the index labels 10 to each of the plurality of adhered to members 2 in an attractive and neat array.

In the embodiment described above, a normal character image is printed on the print label 21 and a transparent cover film is adhered thereon as the cover label 23. However, it is possible to print a reflective character image on the transparent film as the print label 21 and adhere a non-transparent paper to the printed surface of the print label 21 as the cover label 23. Further, if either or both of the print label 21 and the cover label 23 having various colors are temporarily adhered in a predetermined order on the first roll type support member 22 and the second roll type support member 24, the arrangement of the index labels 10 becomes colorful and has a more distinguishing and attention getting appearance.

Further, if various types of cassettes 9, which contain different length print labels and cover labels, and ink ribbon corresponding thereto, are prepared and a thermal print head having a width corresponding to the longest print label is used, it is possible to use differently sized index labels, on which a desired image is printed, for mounting on the adhered member by changing the cassette 9. Additionally, if colored ink ribbons are used in the cassette 9, colorfully printed labels can be obtained.

In the embodiment described above, the adhered to members 2 are inserted into the sheet inlet 3 of the main body case 1 one by one. However, if a sheet feed unit (not shown) is provided at the sheet inlet 3 holding a plurality of the adhered to members 2 and capable of receiving and accumulating processed adhered to members 2 it is possible to automatically execute an insertion of the adhered to member 2 and a discharge of the adhered to member 2 on which the printed index label is adhered.

In the described embodiment, the print label 21 is printed by the thermal print head 40 using the ink ribbon 20. However, if the print label 21 is made of a thermal paper, it can be printed by the thermal print head 40 without using an ink ribbon.

What is claimed is:

1. A label adhesion device for adhering a label on an adhered to member, comprising:

a casing having a portion for receiving the adhered to member;

a carriage mounted in said casing so as to be movable along one side of the adhered to member;

a cassette including a label support member on which a plurality of labels are temporarily adhered, said cassette being detachably mounted on said carriage;

feeding means for feeding the label support member stored in said cassette in a predetermined direction;

moving means for moving said carriage to a desired position along one side of the adhered to member; and pressing means for adhering and pressing the label to the adhered to member at a desired position along the one side of the adhered to member.

2. The label adhesion device according to claim 1, wherein said casing has a window to confirm a type of said cassette which is mounted on said carriage.

3. A label adhesion device for adhering a plurality of labels on a plurality of adhered to members, comprising:

a casing having a portion for receiving the plurality of adhered to members;

a carriage mounted in said casing so as to be movable along one edge of a received adhered to member;

a cassette which is detachably mounted on said carriage;

a first support member on which a plurality of first labels are temporarily adhered, said first support member being stored in said cassette;

a second support member on which a plurality of second labels are temporarily adhered, said second support member being stored in said cassette;

feeding means for feeding said first support member and said second support member in a predetermined direction;

pressing means for adhering and pressing the first label and the second label onto opposing sides of the one edge of the received adhered to member therebetween; and control means for controlling said carriage movement so that a label adhering position on successively received adhered to members may be shifted in a direction along the one edge of each successive adhered to member.

4. The label adhesion device according to claim 3, wherein said casing has a window to confirm a type of said cassette which is mounted on said carriage.

5. The label adhesion device according to claim 3, wherein said portion of said casing comprises an opening for inserting into and removing therefrom each adhered to member.

6. The label adhesion device according to claim 5, wherein the plurality of adhered to members can be inserted into the opening at one time.

7. The label adhesion device according to claim 3, wherein one of the first label and the second label is made of a transparent film.

8. The label adhesion device according to claim 3, wherein a shape of the first label is substantially the same as a shape of the second label.

9. An index label adhesion device for adhering a plurality of index labels on a plurality of adhered to members, comprising:

a casing having a portion for receiving the plurality of adhered to members;

a carriage mounted in said casing to be movable along one edge of one of the adhered to members received in said casing;

a first support member on which a plurality of print labels are temporarily adhered, each print label comprising a base portion which can be adhered on one side of the adhered to member and a projected portion connecting to the base portion and on which a desired image can be printed;

a second support member on which a plurality of cover labels are temporarily adhered;

print means for printing a desired image on the projected portion of the print label;

feeding means for feeding said first support member and said second support member in a predetermined direction;

pressing means for adhering and pressing the print label and the cover label holding the one edge of the received adhered to member therebetween; and control means for controlling said carriage to move so that a label adhering position on successive adhered to members may be shifted in a direction along the one edge of the successive adhered to members.

10. The index label adhesion device according to claim 9, further comprising input means for inputting a distance from an edge of the adhered to member to a position to start to adhere said index label and an interval between each index label.

11. The index label adhesion device according to claim 9, further comprising an ink ribbon, said print means printing the desired image on the projected portion of the print label though said ink ribbon.

12. The index label adhesion device according to claim 11, wherein said first support member, said second support member and said ink ribbon are stored in a cassette which is detachably mounted on said carriage.

13. The index label adhesion device according to claim 11, wherein a width of said ink ribbon corresponds to a width of the print label temporarily adhered on said first support member.

14. The index label adhesion device according to claim 12, wherein various cassettes, one of which contains a certain size of ink ribbon, first support member, and second support member, and another one of which contains another size of ink ribbon, first support member and second support member, can be mounted on said carriage.

15. The index label adhesion device according to claim 9, wherein the cover label having a same plan shape as the print label is adhered to cover from a printed surface of the projected portion to the one edge of the adhered to member.

16. The index label adhesion device according to claim 9, wherein said print means comprises a thermal head arranged on said carriage.

17. The index label adhesion device according to claim 16, wherein the width of the thermal head corresponds to the width of the print label.

18. The index label adhesion device according to claim 9, wherein said casing comprises an opening for inserting and discharging the adhered to members.

19. The index label adhesion device according to claim 18, wherein the plurality of adhered members can be inserted in the opening at one time.

20. The index label adhesion device according to claim 9, wherein said first support member and said second support member are roll type sheets.

* * * * *